US009049894B2

(12) United States Patent
Wong

(10) Patent No.: US 9,049,894 B2
(45) Date of Patent: Jun. 9, 2015

(54) MAGNETIC FASTENERS

(75) Inventor: Sheung Chung Wong, Kowloon (CN)

(73) Assignee: A.O. MAGNETIC SNAP MFY LIMITED, Sham Shui Po, Kowloon (HK)

( * ) Notice: Subject to any disclaimer, the term of this patent is extended or adjusted under 35 U.S.C. 154(b) by 0 days.

(21) Appl. No.: 13/386,967

(22) PCT Filed: Jul. 23, 2010

(86) PCT No.: PCT/IB2010/053357

§ 371 (c)(1),
(2), (4) Date: Jan. 25, 2012

(87) PCT Pub. No.: WO2011/013044

PCT Pub. Date: Feb. 3, 2011

(65) Prior Publication Data

US 2012/0117764 A1 May 17, 2012

(30) Foreign Application Priority Data

Jul. 27, 2009 (HK) ..... 09106885.6

(51) Int. Cl.
*A44B 11/25* (2006.01)
*A41F 1/00* (2006.01)

(52) U.S. Cl.
CPC ..... *A41F 1/002* (2013.01); *Y10T 24/318* (2015.01); *Y10T 24/32* (2015.01); *A44B 11/258* (2013.01); *A44D 2203/00* (2013.01)

(58) Field of Classification Search
CPC ..... A44D 2203/00; A44C 5/2071; A44C 5/2076; A44B 11/258; A44B 11/2592; A45C 13/1069; A41F 1/002; A41F 1/006; E05C 19/161; Y10S 206/818; Y10S 211/01; Y10S 264/58; Y10S 428/90; Y10S 55/06; Y10S 7/901
USPC ..... 24/303
See application file for complete search history.

(56) References Cited

U.S. PATENT DOCUMENTS 2,959,832 A * 11/1960 Baermann ..... 24/303
3,027,617 A * 4/1962 Gray ..... 24/303

(Continued)

FOREIGN PATENT DOCUMENTS

CN 2877342 Y 3/2007
CN 201146895 Y 11/2008

(Continued)

OTHER PUBLICATIONS

International Search Report (PCT/ISA/210) issued on Dec. 23, 2010, by Chinese Patent Office as the International Searching Authority for International Application No. PCT/IB2010/053357.

*Primary Examiner* — Robert J Sandy
*Assistant Examiner* — David Upchurch
(74) *Attorney, Agent, or Firm* — Buchanan Ingersoll & Rooney P.C.

(57) ABSTRACT

A magnetic strap fastener for use with existing strapped articles without modification is presented. The fastener includes first and second fastener parts for attaching to a complementary engagement arrangement on first and second strap ends. The first and second fastener parts are detachably engageable with each other by magnetic coupling or attraction and include complementary engagement devices for detachable engagement with the corresponding complementary engagement arrangement on the strap ends. Such a fastener is advantageous because it offers the benefits of magnetic fasteners and is at the same time readily attachable to an article having strap ends with an existing pair of complementary engagement devices.

19 Claims, 6 Drawing Sheets

(56) References Cited

U.S. PATENT DOCUMENTS

| | | | | |
|---|---|---|---|---|
| 3,063,118 | A | 11/1962 | Salter et al. | |
| 3,129,477 | A * | 4/1964 | Mizuno | 24/303 |
| 3,372,443 | A * | 3/1968 | Daddona, Jr. | 24/303 |
| 4,231,137 | A * | 11/1980 | Fujimoto | 24/303 |
| 5,572,887 | A * | 11/1996 | Geswelli | 63/3 |
| 5,664,298 | A * | 9/1997 | Nessar-Ivanovic | 24/303 |
| 6,292,985 | B1 * | 9/2001 | Grunberger | 24/303 |
| 6,598,271 | B2 * | 7/2003 | Nire | 24/303 |
| 6,606,767 | B2 * | 8/2003 | Wong | 24/303 |
| 6,622,349 | B2 | 9/2003 | Wong | |
| 7,073,232 | B1 * | 7/2006 | Fuhrman et al. | 24/303 |
| 7,207,091 | B2 * | 4/2007 | Dunaye | 24/303 |
| 2002/0000024 | A1 * | 1/2002 | Grunberger | 24/303 |

FOREIGN PATENT DOCUMENTS

| | | | |
|---|---|---|---|
| JP | 2001-115306 | A | 4/2001 |
| WO | WO 03/005847 | A1 | 1/2003 |

* cited by examiner

MAGNETIC FASTENERS

FIELD OF THE INVENTION

The present invention relates to magnetic fasteners, and more particularly to magnetic fasteners for securing to strap ends. More specifically, the present invention relates to articles comprising magnetic fasteners secured to strap ends, such articles include, for example, brasseries, back packs, clothing or apparels, shoes, etc.

BACKGROUND OF THE INVENTION

Magnetic fasteners provide a useful alternative to conventional mechanical interlocking fasteners and are finding increasing use in many applications.

For example, U.S. Pat. Nos. 6,606,767 and 6,622,349 of the same inventor discloses a magnetic strap fastener comprising a pair of magnetic fastener parts of opposite polarity. Each of the magnetic fastener part comprises a magnetic housing which embraces a strong magnet slab, a strap attachment means for securing to a strap end, and a stop. The stop is adapted to act against or resist longitudinal separation movement when a separation force is applied on the strap ends. The housing portion surrounding the magnet slab forms a magnetic force concentrator which operates to automatically align the magnetic housing of the counterpart magnetic fastener parts when the fastener parts are in magnetic proximity of each other when the exposed magnetic coupling surfaces are facing each other. U.S. Pat. Nos. 6,606,767 and 6,622,349 are incorporated herein by reference.

Magnetic fasteners are advantageous because they are easy to use and provide strong fastening. For example, due to the use of strong magnets and the magnetic concentrating housing, the fastener parts will be automatically and self aligned into the magnetic coupled configuration once the fastener parts are in magnetic proximity to each other. On the other hand, the magnetic fastener parts could be easily detached by relative tilting to move the fastener parts away from magnetic coupling, and followed by subsequent detachment, as described in the above patent publications. Moreover, an array of magnetic buttons can be fastened or released simultaneously, while conventional fasteners such as button assemblies have to be fastened and released sequentially.

In particular, magnetic fasteners are particularly useful in situations where fasteners are required to be done and undone by a single hand and in a short time. Therefore, magnetic fasteners are finding increasing use in brasseries and other clothing items where fasteners are located on the back side.

While magnetic fasteners described in the above patent publications are already advantageous, further improvements are desirable in order to make magnetic fasteners more commercially attractive and/or more user friendly.

SUMMARY OF THE INVENTION

According to the present invention, there is provided a magnetic strap fastener comprising first and second fastener parts for attaching to complementary engagement means on first and second strap ends, wherein the first and second fastener parts are detachably engage-able with each other by magnetic coupling or attraction and comprise complementary engagement means for detachable engagement with the corresponding complementary engagement means on the strap ends. Such a fastener is advantageous because it offers the benefits of magnetic fasteners and is at the same time readily attachable to an article having strap ends with an existing pair of complementary engagement means. This enables the magnetic fastener to be used with existing strapped articles without modification.

In one embodiment, the first and second fastener parts of the magnetic strap fastener upon magnetic coupled engagement is adapted to resist or act against separation of the first and second fastener parts when a separation tension or pulling tension is applied on the strap ends in a longitudinal direction, and the complementary engagement means of the first and second fastener parts are on opposite longitudinal ends of the magnetically coupled and engaged first and second fastener parts. Such an arrangement provides more effective resistance against a separation force which is applied lengthwise or longitudinally on the strap ends, since such a separation force is the usual separation force which needs to be overcome in strap fastened articles.

The first and second fastener parts of the magnetic strap fastener may be adapted for magnetic coupled engagement in a magnetic coupling direction, the magnetic coupling direction being substantially orthogonal to the direction of application of the longitudinal separation or pulling tension on the strap ends. Such a transverse or orthogonal force relationship facilitates strong and effective fastening coupling while permits detachment without undue efforts.

The complementary engagement means may comprise a hook or claw arrangement and a complementary aperture or slot arrangement. A hook or a claw provides easy and convenient attachment to a slotted receptacle commonly used in strap fastened articles.

The hook or craw arrangement may comprise a plurality of hooks or claws which is aligned in a line transverse to the longitudinal direction. The plurality of hooks or claws facilitates more even and balanced engagement with the strap ends.

In one embodiment, at least one of the first and second magnetic fastener parts comprises a magnetic housing such as a ferromagnetic housing which embraces a magnet slab to facilitate magnetic coupled engagement between the first and second magnetic fastener parts, and wherein a stop and an engagement means are formed on the magnetic housing; characterized in that the stop and the engagement means are distributed on opposite longitudinal sides or ends of the magnetic housing.

In another embodiment, each one of the first and second magnetic fastener comprises a magnetic housing in which a magnet slab is embraced to facilitate magnetic coupled engagement between the first and second magnetic fastener parts, and wherein a stop and an engagement means are formed on the magnetic housing; characterized in that the stop and the engagement means are distributed on opposite longitudinal sides or ends of the magnetic housing.

The magnetic housing may be arranged such that a housing portion surrounding the magnet slab on one of the fastener parts has a counterpart housing portion on the other one of the fastener parts, the counterpart housing portions are arranged such that opposite magnetic polarity on the counterpart housing portions brings the first and second fastener parts into mutual coupling alignment when the first and second fastener parts are brought into proximity of each other.

In one embodiment, an exposed magnetic coupling surface of the magnet slab is flush with the counterpart housing except at the stop, the stop comprising a tooth portion protruding from the counterpart housing. The flush coupling surface provides optimal coupling while the stop provides effective resistance against longitudinal separation.

For example, the stop and the engagement means may be integrally formed on the magnetic housing. The integral arrangement promotes better structural integrity for user comfort and ease of mind.

In another embodiment, a receptacle is formed on the housing for receiving the stop, the stop and receptacle arrangement being arranged to cooperate to resist detachment separation due to application of a longitudinal separation force on the strap ends after the first and second fastener parts are in magnetic coupled engagement. The stop and receptacle arrangement further provides resistance against relative lateral movement in a direction transverse to the longitudinal direction of the straps and provide additional user comfort and ease of mind. As an example, both the receptacle and the stop are elongate or have an overall elongate shape.

For example, the magnetic housing may be rectangular, and a major axis of the housing is transverse to the direction of longitudinally tensioned straps during use. The rectangular arrangement ensures that the magnetic fastener could be used in a predetermined configuration without undue difficulty. Of course, the magnetic slab and the housing portion embracing same could be square, oval, circular without loss of generality.

In another aspect of the present invention, there is provided a magnetic fastener part of a magnetic fastener described herein and comprising an attachment means for detachably attaching to a strap end.

For example, the attachment means may comprise at least a hook or a claw for detachable attachment to at least a receptacle on a strap end.

For example, the attachment means may comprise hooks or claws for detachable attachment to corresponding receptacles or slots on a strap end, the hooks or claws being distributed on transverse ends of the attachment means.

In yet other aspect of the present invention, there is provided a magnetic strap fastener comprising first and second fastener parts for attaching respectively to first and second strap ends, the first and second fastener parts being adapted for interlocking engagement by magnetic attraction between the first and the second fastener parts, wherein at least one of the first or the second fastener parts comprises a lateral stop which is adapted to act against relative separation movement between the first and second fastener parts when subject to a longitudinal separation force after the first and second fastener parts have been magnetically coupled; characterized in that the other one of the at least one of the first or the second fastener parts comprises a receptacle for receiving the stop when the first and second fastener parts are interlocked, the receptacle being arranged to resist or act against a separation tension of the stop in the direction of a longitudinal separation force. The receptacle and stop arrangement provides resistance against relative separation movement both longitudinally and transversely.

The stop may comprise a tooth portion and the receptacle may comprise a slot for receiving the tooth portion in an interlocking manner.

For example, the slot may be substantially transverse to the longitudinal direction.

According to yet another aspect of the present invention, there is provided a brassiere, shoe, backpack, clothing or apparel comprising a magnetic fastener or a magnetic fastener part according to any of the preceding Claims.

Accordingly, this invention provides a pair of magnetic fasteners including a first magnetic fastener and a matching second magnetic fastener. Said first magnetic fastener is for securing to a first strap end and said second magnetic fastener is for securing to a second strap end. Each of said first strap end and said second strap end has at least one strap end securing member. Each of said first magnetic fastener and second magnetic fastener including a housing and a magnetic member. This housing includes:

a casing for holding said magnetic member; and a strap attachment means for securing to said strap end securing member, said strap attachment means extending from said casing.

Preferably, the strap attachment means is for detachably securing to said strap end securing member.

Preferably, the strap end securing member is a non-magnetic securing member.

Advantageously, the casing is made of a ferromagnetic material shaped to expose a magnetic coupling surface of said magnetic member while surrounding remaining surfaces of said magnetic member.

Preferably, the strap attachment means has at least one magnetic fastener securing member for securing to said strap end securing member. More preferably, the magnetic fastener securing member is a non-magnetic securing member. Alternatively, the magnetic fastener securing member is for detachably securing to said strap end securing member.

More preferably, said magnetic fastener securing member is mechanically complementary to said strap end securing member for securing to said strap end securing member. Preferably, the at least one of said first or second securing member of corresponding said first or second magnetic fastener is a hook, and at least one of corresponding said first or second strap end securing member of corresponding said first or second strap end is a loop complementary to said hook. Alternatively, at least one of said first or second magnetic fastener securing member and corresponding said first or second strap end securing member are first complementary buckles. Optionally, the at least one of said first or second said magnetic fastener securing member is a clasp, and corresponding said first or second said strap end securing member is a ring complementary to said clasp. The at least one of said first or second said magnetic fastener securing member and corresponding said first or second said strap end securing member can also be complementary Velcro™ fasteners.

Advantageously, said first strap end and said second strap end are connected to an article selected from the group consisting of bra, shape-up lingerie, shoe, suitcase, coat, jacket, dresses, shirts, and trousers, more preferably a bra. Even more preferably, the at least one magnetic fastener securing member of said first magnetic fastener is a hook, and the strap end securing member of the first strap end is a loop; and the at least one magnetic fastener securing member of said second magnetic fastener is a loop, and the strap end securing member of the second strap end is a hook.

Preferably, the casing has a shape selected from the group consisting of circle, oval, rectangle, square, triangle, parallelogram, trapezoid, pentagon, hexagon, and octagon, more preferably a rectangle.

Preferably, the magnetic coupling force between the magnetic fasteners of the current invention is about 20-30N.

It is another aspect of the current invention to provide a magnetic fastener for securing to a strap end having at least one strap end securing member, said magnetic fastener including a housing and a magnetic member, said housing including:

a casing for holding said magnetic member; and a strap attachment means for grasping said strap end securing member, said strap attachment means extending from said casing.

It is another aspect of the current invention to provide a first magnetic fastener for securing to a strap end having at least one strap end securing member, said magnetic fastener including a housing and a magnetic member, said housing including:

a casing for holding said magnetic member; and a strap attachment means for grasping said strap end securing member, said strap attachment means extending from said casing.

and a second magnetic fastener for securing to a second strap end having at least one strap end securing member and for magnetically coupling to said first magnetic fastener, said second magnetic fastener including a second housing and a second magnetic member, said second housing including:

a second casing for holding said second magnetic member; and a second strap attachment means for securing to said second strap end securing member, said second strap attachment means extending from said second casing.

BRIEF DESCRIPTION OF THE DRAWINGS

Exemplary embodiments of the present invention will be explained below by way of example and with reference to the accompanying drawings in which.

DETAILED DESCRIPTION OF THE PREFERRED EMBODIMENTS

Figure 1:
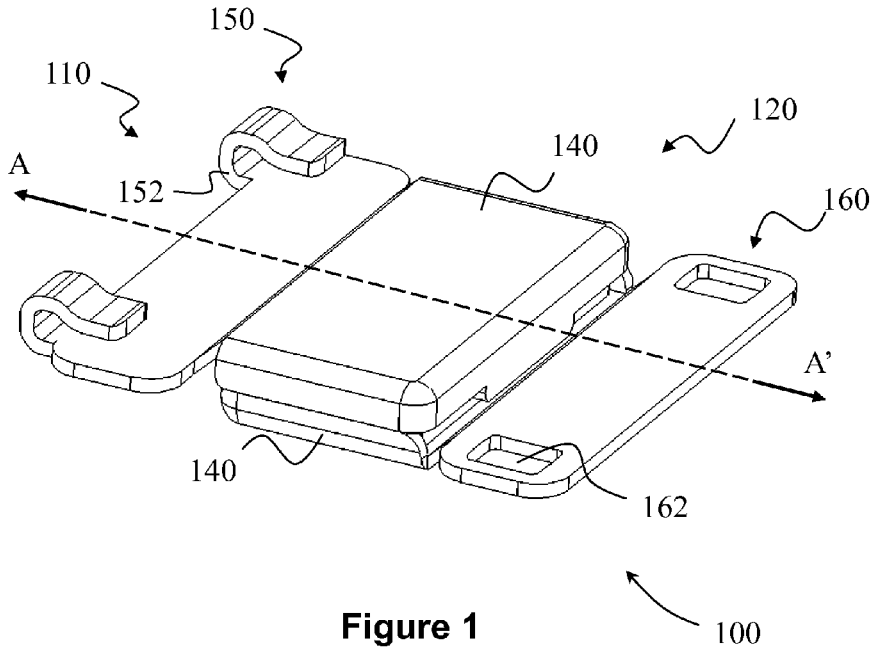
FIG. 1 is a first perspective view of a magnetic fastener according to an embodiment of the present invention.
Figure 1A:
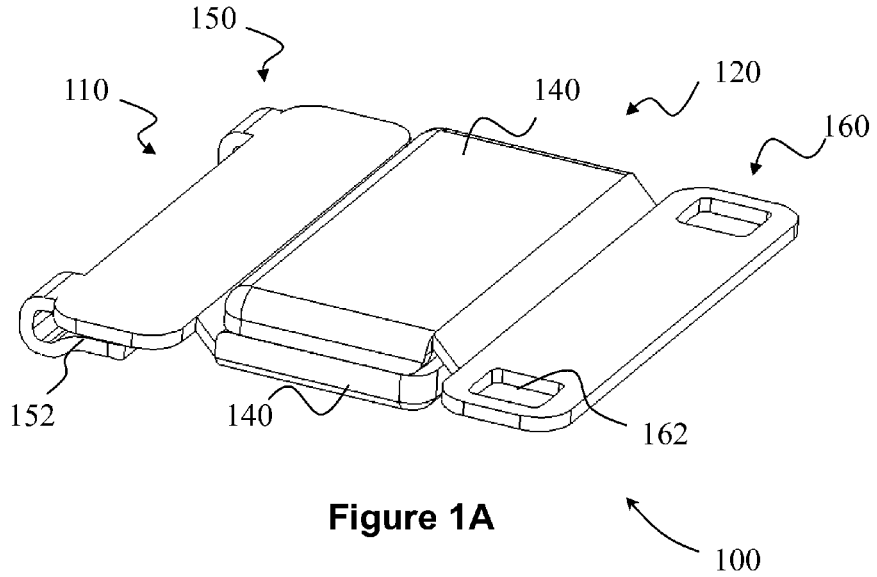
FIG. 1A is a second perspective view of the magnetic fastener of FIG. 1.

A magnetic strap fastener 100 of FIG. 1 illustrates a first exemplary embodiment of the present invention. The magnetic fastener 100 comprises a first magnetic fastener part 110 and a second magnetic fastener part 120. Each of the fastener parts comprises a magnet slab 130, a magnetic housing 140 embracing the magnet slab, a strap attachment means 150, 160 and a stop 170. The magnet slab is housed in the magnetic housing such that a magnetic surface of one polarity is attached to and juxtaposes a base portion of the housing while a magnetic surface of the opposite polarity is exposed for magnetic coupling with a magnetic surface of a counterpart fastener part.

The portion of the magnetic housing embracing the magnet defines a magnet receptacle having an upstanding wall 142 which rises from the base portion of the housing. The upstanding wall encompasses all sides of the magnet except the side proximal the strap attachment side. Due to magnetic contact between the base portion of the housing and the magnet, the upstanding wall has the same polarity as that of the magnetic surface juxtaposing the base portion of the housing. As a result, the magnetic coupling surface of a fastener part comprises in combination a first magnetic surface of a first polarity of the magnet slab and a second magnetic surface of a second, opposite, polarity on the edge on the surrounding and upstanding wall. In this arrangement, the magnetic coupling surface comprises a first magnetic surface of the magnet slab embraced by a second elongate magnetic surface of opposite polarity. Such an arrangement of a magnetic coupling surface comprising opposite magnetic polarities on the same coupling surface facilitates strong magnetic coupling as well as automatic alignment of counterpart magnetic fasteners when the respective magnetic coupling surfaces are brought into magnetic proximity. As an example, a pair of complementary magnetic slabs having a diameter of 1 cm and a thickness of about 1 mm has a magnetic coupling force of up to 20-30 N which would provide sufficient securing for most ordinary uses.

An elongate slot is formed intermediate the magnet slab and the strap attachment means for receiving a stop of a counterpart fastener part to resist longitudinal separation movement along direction A-A' of the Figures. The elongate slot is transverse to the longitudinal direction of the separation force, which is typically applied along the length of straps to which the fastener parts are attached.

A toothed portion as an example of a stop is formed on the portion of the upstanding wall distal from the slot. This toothed portion is elongate and extends transversely to the longitudinal direction or parallel to the slot. The extent of protrusion of the toothed portion is adapted such that the toothed portion and base portion of the housing defining the slot are juxtaposed.

Each of the fastener parts comprises an attachment means for detachable attachment to a strap 10 end and the fastener in its fastened configuration of FIG. 1 comprises a pair of attachment means for engaging with a pair of complementary engagement means usually found on strap ends of strap fasten-able articles. Each of the attachment means is formed on a fastener part distal from the stop. More specifically, the attachment means and the stop of each fastener part are formed on longitudinal ends or extremities of the fastener housing for mechanical efficiency.

Figure 2:
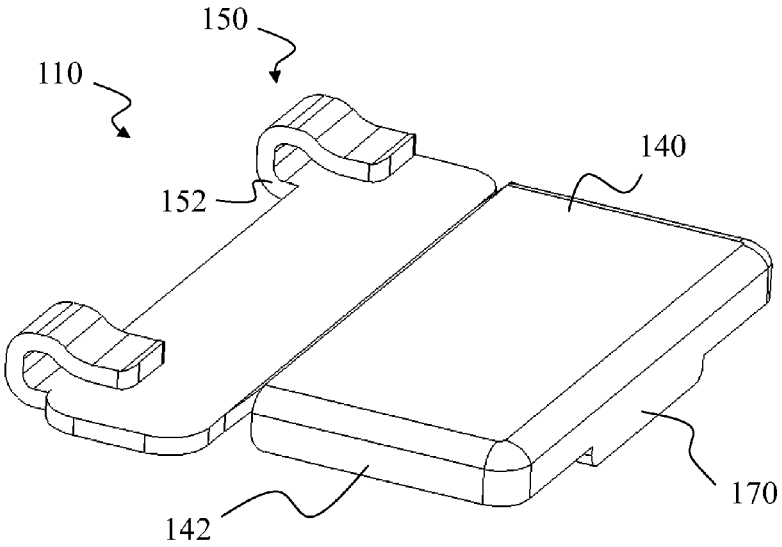
FIG. 2 is a first perspective view of a first magnetic fastener part of the magnetic fastener of FIG. 1.
Figure 2A:
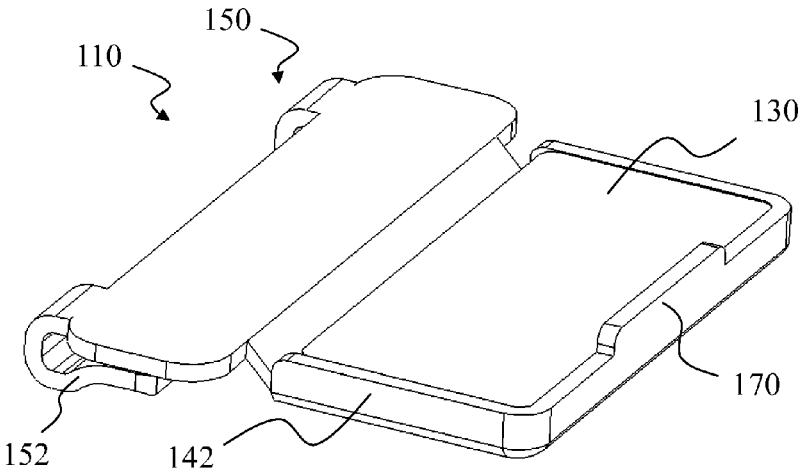
FIG. 2A is a second perspective view of the first magnetic fastener part of the magnetic fastener of FIG. 1.

In the male fastener part of FIGS. 2 and 2A, a pair of hooks or claws 152 is used as an example of an attachment means. The hooks are distributed on the transversal ends on a rear portion of the housing for more balanced and secured attachment. The hooks are adapted for detachable attachment or engagement with a counterpart female attachment means on a strap end, such as a clasp.

Figure 3:
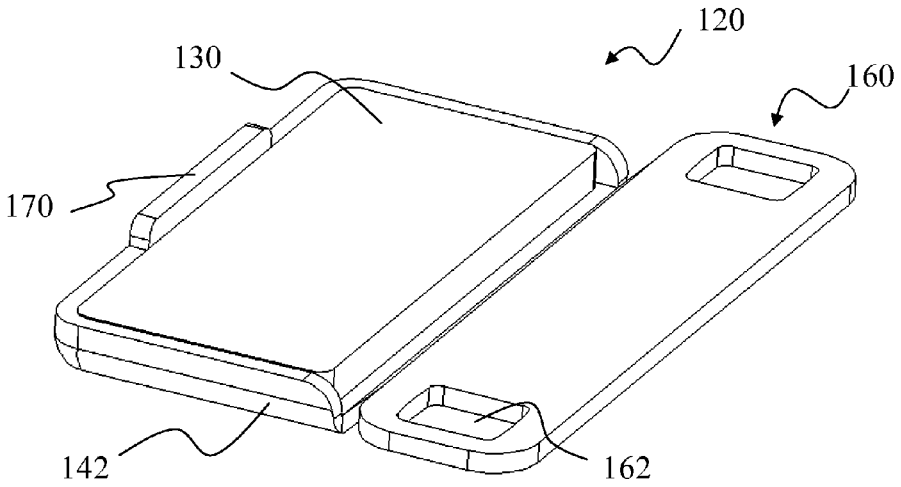
FIG. 3 is a first perspective view of a second magnetic fastener part of the magnetic fastener of FIG. 1.
Figure 3A:
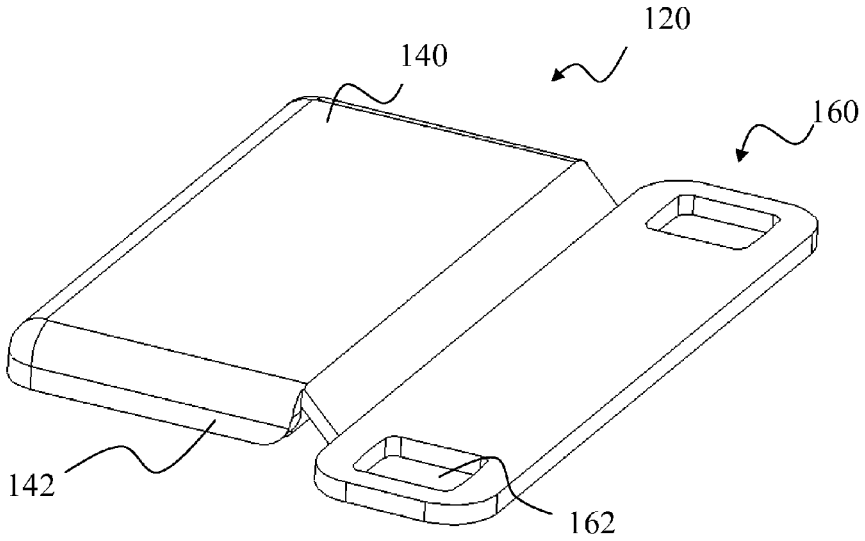
FIG. 3A is a second perspective view of the second magnetic fastener part of the magnetic fastener of FIG. 1.

In the female fastener part of FIGS. 3 and 3A, a pair of slots or apertures 162 formed on the housing is used as an example of an attachment means. The apertures or slots are also distributed on the transversal ends on a rear portion of the housing for more balanced and secured attachment. Likewise, the apertures are adapted for detachable attachment or engagement with the counterpart male attachment means on a strap end, such as a pair of hooks.

As the attachment means on strap ends are typically a counterpart or complementary pair, the attachment means on the fastener are also a counterpart of complementary pair without loss of generality. Furthermore, since the attachment means of the magnetic fastener is adapted to be compatible with that on strap ends, the magnetic fastener could be used as an attachment to existing strap fasten-able articles such as brasseries, shoes, or back packs. Such existing strap fastenable articles typically comprise a pair of counterpart attachment means for detachable attachment which are well-known to persons skilled in the art.

Figure 4:
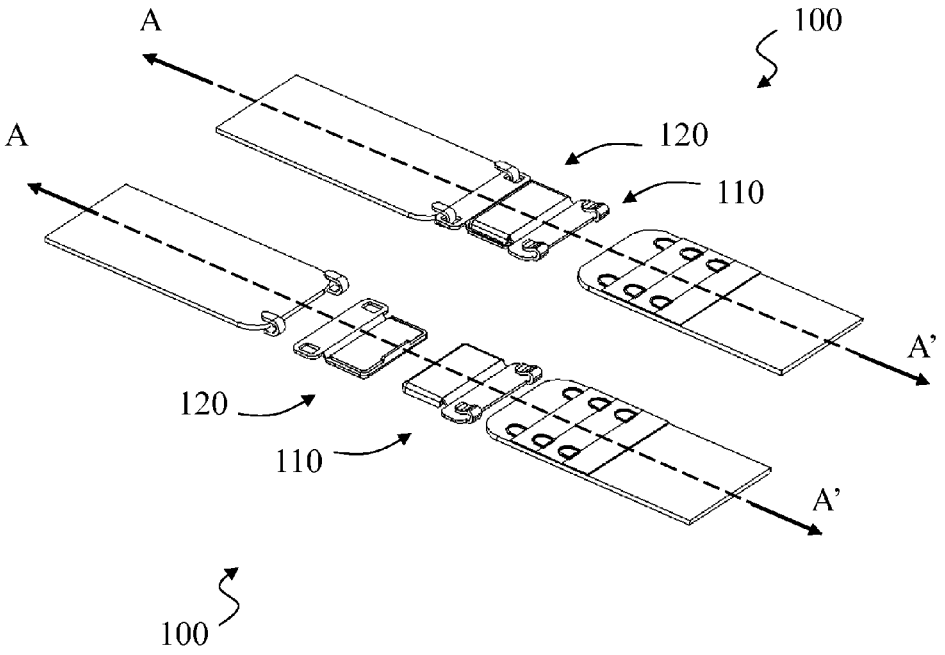
FIG. 4 is a schematic diagram depicting the magnetic fastener and associated strap ends.

In use, the magnetic fastener is attached to the strap ends by way of the attachment means, as shown in FIG. 4. Once the magnetic fastener is attached on to the strap ends, the strapped article is converted into a strap fastenable article comprising a magnetic fastener. When the straps or strap ends are subject to a longitudinally applied separation tension (for example, pulling tension) along the length of the straps, the stop will resist or act against the separation tension, thereby maintaining the article in a strap connected configuration. When it is desirable to release the fastening, a user may simply tilt one of the fastener parts relative to another to detach the fastener parts from mutual magnetic coupling.

Figure 5:
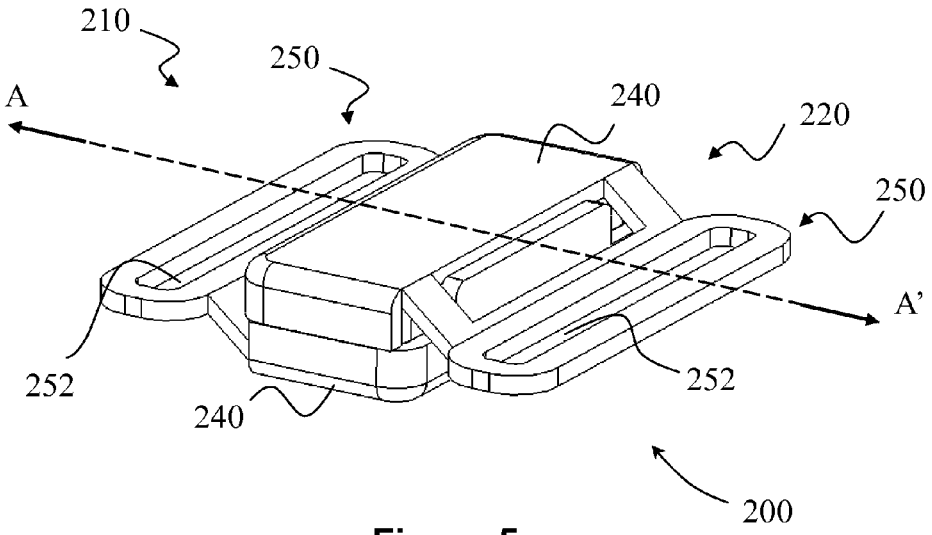
FIG. 5 is a first perspective view of a magnetic fastener according to a second embodiment of the present invention.
Figure 5A:
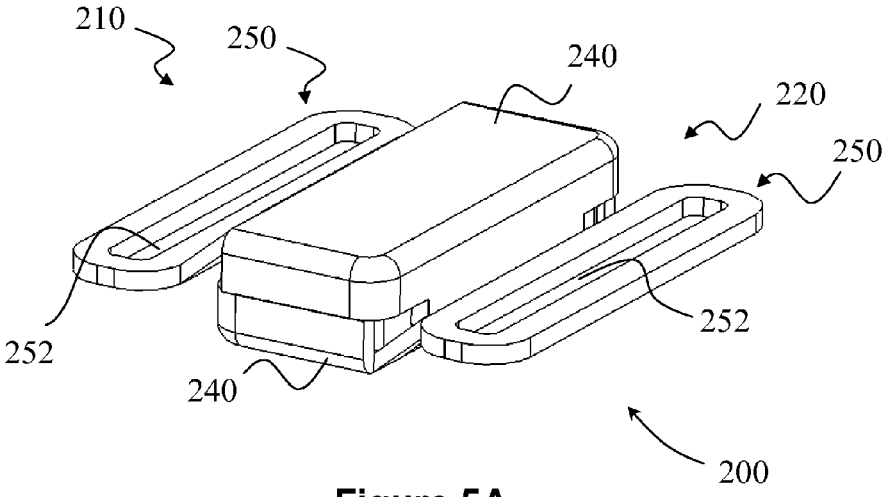
FIG. 5A is a second perspective view of the magnetic fastener of FIG. 5.
Figure 6:
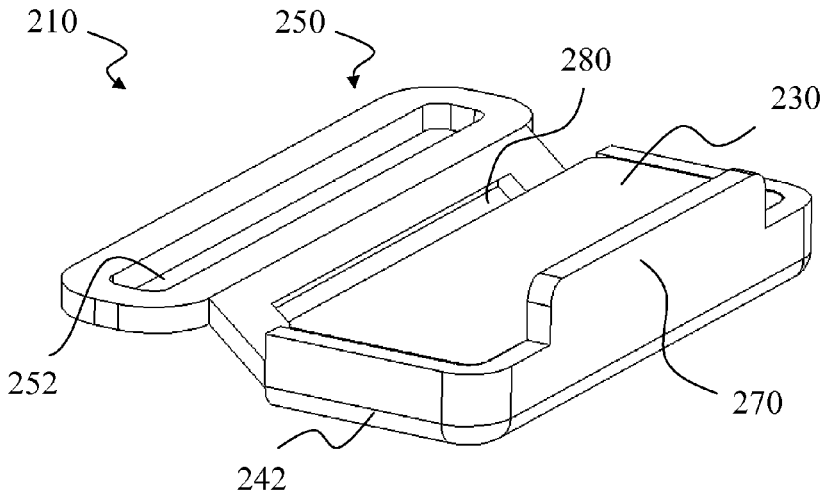
FIG. 6 is a first perspective view of a first magnetic fastener part of the magnetic fastener of FIG. 5.
Figure 6A:
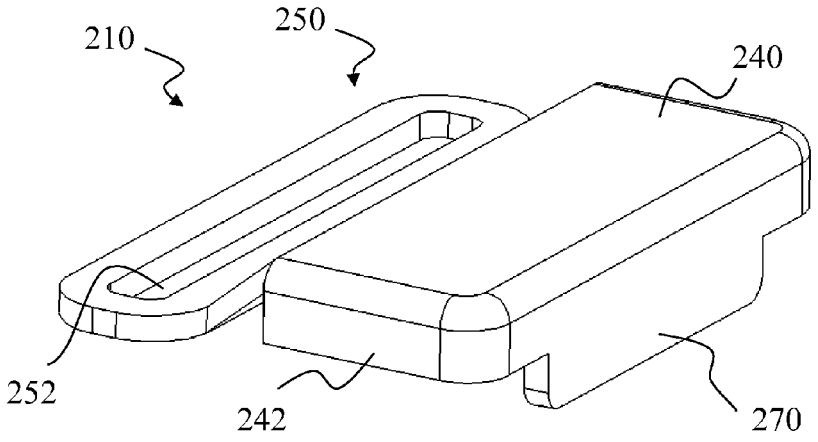
FIG. 6A is a second perspective view of the first magnetic fastener part of the magnetic fastener of FIG. 1.

The magnetic fastener 200 of FIGS. 5 and 5A illustrates a second embodiment of the present invention. The magnetic fastener 200 of FIGS. 5 and 5A also comprises a first magnetic fastener part 210 and a second magnetic fastener part 220. Each of the fastener parts comprises a magnet slab 230, a magnetic housing 240 embracing the magnet slab, a strap attachment means 250 and a stop 270. The magnet slab is housed in the magnetic housing such that a magnetic surface of one polarity is attached to and juxtaposes a base portion of the housing while a magnetic surface of the opposite polarity is exposed for magnetic coupling with a magnetic surface of a counterpart fastener part. While the magnetic fastener of FIGS. 5 and 5A also comprises strap attachment means, the strap attachment means need not be complementary and could be of the same mechanical gender. As shown in FIGS. 5, 5A, 6 and 6A, each of the magnetic fastener part comprises a slotted portion 252 on the part of the housing distal from the stop as an example of an attachment means. Of course, the attachment means could be complementary or could be male only, such as hooks or claws, without loss of generality.

In this specification, the term attachment means and engagement means are interchangeable in so far as the fastener parts are concerned.

The magnetic fastener 200 comprises a through slot 280 for receiving the stop in an interlocking relationship. The elongate slot 280 is formed on the portion of the housing intermediate the strap attachment means and the magnet slab such that the stop and the slot are in an interlocked relationship when the fastener is in magnetic coupling engagement. The slot and stop arrangement further mitigates the risk of relative lateral movement, as well as mitigating the risk of detachment due to accidental tension applied in the direction of magnetic coupling, for example, due to chest expansion during exercise.

While the present invention has been explained with reference to the above exemplary embodiments, it should be appreciated that the embodiments are non-limiting examples which are provided merely for illustration purposes and should not be used to limit or restrict the scope of invention. For example, while a magnetic coupling surface having opposite magnetic polarity on the same coupling surface has been described, a magnetic fastener part of the present invention may have a single polarity magnetic coupling surface without loss of generality. In addition, while a strap or strap end has been referred to in the above, it should be appreciated that reference to a strap includes reference to a belt, line, string or other flexible linkage means without loss of generality. Furthermore, while a rectangular magnetic housing has been used as examples, the housing could be circular, oval, elliptical, polygonal or other appropriate shapes without loss of generality.

Table of Numerals

| | | | |
|---|---|---|---|
| 100 | Magnetic strap fastener | | |
| | 110 | | First magnetic fastener part |
| | 120 | | Second magnetic fastener part |
| | 130 | | Magnet slab |
| | 140 | | Magnetic housing |
| | | 142 | Upstanding wall |
| | 150 | | Strap attachment means |
| | | 152 | Claws |
| | 160 | | Strap attachment means |
| | | | Apertures |
| | 170 | | Stop |
| 200 | Magnetic fastener | | |
| | 210 | | First magnetic fastener part |
| | 220 | | Second magnetic fastener part |
| | 230 | | Magnet slab |
| | 240 | | Magnetic housing |
| | 250 | | Strap attachment means |
| | | 252 | Slotted portion |
| | 270 | | Stop |
| | 280 | | Slot |
| 10 | Strap | | |

What is claimed:

1. A magnetic fastener assembly comprising a first fastener part for attaching to a first engagement end of a first strap end and a second fastener part for attaching to a second engagement end on a second strap end, wherein the first and second fastener parts are detachably engageable with each other by magnetic coupling or attraction and comprise complementary engagement devices for making detachable engagement with corresponding complementary engagement devices on the first and second engagement ends of the first and second strap ends;

wherein the first fastener part comprises a first fastener housing defining a first engagement device on a first longitudinal end and a first magnetic coupling surface longitudinally displaced from the first longitudinal end, and the second fastener part comprises a second fastener housing defining a second engagement device on a second longitudinal end and a second magnetic coupling surface longitudinally displaced from the second longitudinal end;

wherein the first and second longitudinal ends are aligned in a longitudinal direction and on opposite longitudinal ends when said first and second fastener parts are brought into magnetic coupled engagement in a magnetic coupling direction which is orthogonal or substantially orthogonal to the longitudinal direction;

wherein the first engagement device and the second engagement device are mechanically complementary and mechanically latchable, securable or engageable with each other when the first and second fastener parts are not in magnetic coupled engagement;

wherein the second fastener housing comprises a second magnetic housing, the second magnetic housing including a second magnetic wall portion extending in the magnetic coupling direction and surrounding a second peripheral portion of a second magnet slab, and the second magnet slab comprising a bottom magnetic surface of a second magnetic polarity in magnetic abutment with the second magnetic housing and a top magnetic surface of a first magnetic polarity which is exposed to facilitate the magnetic coupled engagement, the second magnetic polarity being complementary to the first magnetic polarity;

wherein the first fastener housing includes a first stop of a first magnetic polarity on a longitudinal end distal to the first longitudinal end, and the second magnetic wall portion discontinues at a location oppositely facing the second engagement device in the longitudinal direction to define a second receptacle to receive the first stop when said first and second fastener parts are in magnetic coupled engagement; and wherein the first stop projects in the magnetic coupling direction and is in magnetic abutment with the second fastener housing when said first and second fastener parts are in magnetic coupled engagement.

2. The magnetic fastener assembly according to claim 1, wherein the first fastener housing and the second fastener housing are shaped to cooperate to resist or act against separation of the first and second fastener parts when a separation tension or pulling tension is applied on the strap ends in a longitudinal direction after the first and second magnetic fastener parts are in magnetic coupled engagement.

3. The magnetic fastener assembly according to claim 1, wherein the first fastener housing includes a first stop on a longitudinal end distal to the first longitudinal end, and the second fastener housing includes a second stop on a longitudinal end distal to the second longitudinal end; and wherein the first stop and the second stop are shaped to cooperate to resist or act against separation of the first and second fastener parts when a separation tension or pulling tension is applied on the strap ends in a longitudinal direction after the first and second magnetic fastener parts are in magnetic coupled engagement.

4. The magnetic fastener assembly according to claim 1, wherein the complementary engagement device comprises a hook or claw arrangement and an aperture or slot arrangement which is complementary to said hook or claw arrangement.

5. The magnetic fastener assembly according to claim 4, wherein the hook or claw arrangement comprises a plurality of hooks or claws aligned in a direction transverse to the longitudinal direction.

6. The magnetic fastener assembly according to claim 1, wherein the first fastener housing comprises a first magnetic housing, the magnetic housing including a first magnetic wall portion extending in the magnetic coupling direction and surrounding a first peripheral portion of a first magnet slab, and the first magnet slab comprising a bottom magnetic surface of a first magnetic polarity in magnetic abutment with the first magnetic housing and a top magnetic surface of a second magnetic polarity which is exposed to facilitate the magnetic coupled engagement; and wherein the first magnetic wall portion and the second magnetic wall portion are magnetically complementary and are in magnetic abutment when the first and second magnetic fastener parts are in magnetic coupled engagement.

7. The magnetic fastener assembly according to claim 6, wherein the first magnetic wall portion has an wall outline and a wall thickness comparable to that of the second magnetic wall portion such that the first and second magnetic wall portions are aligned in the magnetic coupling direction in magnetic coupled abutment when said first and second fastener parts are brought into magnetic coupled engagement.

8. The magnetic fastener assembly according to claim 7, wherein the first magnetic wall portion is flush with the exposed top magnetic surface of the first magnet slab to cooperatively define the first magnetic coupling surface and the second magnetic wall portion is flush with the exposed top magnetic surface of the second magnet slab to cooperatively define the second magnetic coupling surface complementary to the first magnetic coupling surface.

9. The magnetic fastener assembly according to claim 1, wherein the second receptacle extends transversely across the second magnetic housing and exposing a peripheral wall portion of the second magnetic slab, the width of the exposed peripheral wall portion of the second magnetic slab being comparable to the transversal extent of the first stop.

10. The magnetic fastener assembly according to claim 1, wherein the second fastener housing includes a second stop of a second magnetic polarity on a longitudinal end distal to the second longitudinal end;

wherein the first stop and the second stop are shaped to cooperate to resist or act against separation of the first and second fastener parts when a separation tension or pulling tension is applied on the first and second strap ends in a longitudinal direction after the first and second magnetic fastener parts are in magnetic coupled engagement; and wherein the first magnetic wall portion discontinues at a location oppositely facing the first engagement device in the longitudinal direction to define a first receptacle to receive the second stop when said first and second fastener parts are in magnetic coupled engagement.

11. The magnetic fastener assembly according to claim 10, wherein the first receptacle extends transversely across the first magnetic housing and exposing a peripheral wall portion of the first magnetic slab, the width of the exposed peripheral wall portion of the first magnetic slab being comparable to the transversal extent of the second stop.

12. The magnetic fastener assembly according to claim 11, wherein the complementary engagement device comprises a hook or claw arrangement and an aperture or slot arrangement which is complementary to said hook or claw arrangement;

wherein the hook or claw arrangement comprises a plurality of hooks or claws aligned in a transversal direction which is transverse to the longitudinal direction; and wherein the first stop projects from the first magnetic housing in the magnetic coupling direction and extends transversely to define a first width comparable to separation distance between adjacent hooks or adjacent claws.

13. The magnetic fastener assembly according to claim 3, wherein the first magnetic wall portion discontinues at a location longitudinally facing the first engagement device to define a first indentation to receive the second stop when said first and second fastener parts are in magnetic coupled engagement.

14. The magnetic fastener assembly according to claim 1, wherein the first fastener housing comprises a first magnetic housing having a first magnetic wall portion in abutment with a peripheral portion of a first magnet slab, the first magnet slab comprising a bottom surface of a first magnetic polarity in magnetic abutment with the first magnetic housing and a top surface of a second magnetic polarity which is exposed to facilitate the magnetic coupled engagement; and wherein the first fastener housing extends longitudinally to define the first engagement device.

15. The magnetic fastener assembly according to claim 14, wherein the second fastener housing comprises a second magnetic housing having a second magnetic wall portion in abutment with a peripheral portion of a second magnet slab, the second magnet slab comprising a bottom surface of a second magnetic polarity in magnetic abutment with the second magnetic housing and a top surface of a first magnetic polarity which is exposed to facilitate the magnetic coupled engagement; and wherein the second fastener housing extends longitudinally to define the second engagement device.

16. A strap fastenable article such as a brassiere, shoe, backpack, clothing or apparel comprising a magnetic fastener according to claim 1, wherein the magnetic fastener is releasably attachable to strap ends of the article to bring about fastening, and the first and second fastener parts are releasable from mutual magnetic fastening.

17. A magnetic fastener assembly comprising a first fastener part for attaching to a first engagement end of a first strap end and a second fastener part for attaching to a second engagement end on a second strap end;

wherein the first and second fastener parts are detachably engagable with each other by magnetic coupling or attraction and comprise complementary engagement devices for making detachable engagement with corresponding complementary engagement devices on the first and second engagement ends of the first and second strap ends;

wherein the first fastener part comprises a first fastener housing defining a first engagement device on a first longitudinal end and a first magnetic coupling surface longitudinally displaced from the first longitudinal end, and the second fastener part comprises a second fastener housing defining a second engagement device on a second longitudinal end and a second magnetic coupling surface longitudinally displaced from the second longitudinal end;

wherein the first and second longitudinal ends are aligned in a longitudinal direction and on opposite longitudinal ends when said first and second fastener parts are brought into magnetic coupled engagement in a magnetic coupling direction which is orthogonal or substantially orthogonal to the longitudinal direction;

wherein the first engagement device and the second engagement device are mechanically complementary and mechanically latchable, securable, or engageable with each other when the first and second fastener parts are not in magnetic coupling engagement; and wherein the first engagement device is an integral extension of the first magnetic housing and the second engagement device is an integral extension of the second magnetic housing; and wherein the first engagement device and the second engagement device are magnetically complementary to each other.

18. A magnetic fastener assembly comprising a first fastener part for attaching to a first engagement end of a first strap end and a second fastener part for attaching to a second engagement end on a second strap end;

wherein the first and second fastener parts are detachably engageable with each other by magnetic coupling or attraction and comprise complementary engagement devices for making detachable engagement with corresponding complementary engagement devices on the first and second engagement ends of the first and second strap ends;

wherein the first fastener part comprises a first fastener housing defining a first engagement device on a first longitudinal end and a first magnetic coupling surface longitudinally displaced from the first longitudinal end, and the second fastener part comprises a second fastener housing defining a second engagement device on a second longitudinal end and a second magnetic coupling surface longitudinally displaced from the second longitudinal end;

wherein the first and second longitudinal ends are aligned in a longitudinal direction and on opposite longitudinal ends when said first and second fastener parts are brought into magnetic coupled engagement in a magnetic coupling direction which is orthogonal or substantially orthogonal to the longitudinal direction;

wherein the first engagement device and the second engagement device are mechanically complementary and mechanically latchable, securable, or engageable with each other when the first and second fastener parts are not in magnetic coupled engagement;

wherein the first engagement device has a first magnetic polarity and the first magnetic coupling surface comprises a top magnetic surface of a first magnet slab which is exposed for magnetic coupled engagement and a first magnetic wall portion surrounding a peripheral portion of the first magnet slab and extending in the magnetic coupling direction;

wherein the first magnetic wall portion has the first magnetic polarity and the top magnetic surface of the first magnet slab has a second magnetic polarity, the second magnetic polarity being magnetically complementary to the first magnetic polarity.

19. The magnetic fastener assembly according to claim 18, wherein the second engagement device has the second magnetic polarity and the second magnetic coupling surface comprises a top magnetic surface of a second magnet slab which is exposed for magnetic coupled engagement and a second magnetic wall portion surrounding a peripheral portion of the second magnet slab and extending in the magnetic coupling direction;

wherein the second magnetic wall portion has the second magnetic polarity and the top magnetic surface of the second magnet slab has the first magnetic polarity.

* * * * *